United States Patent [19]

Shoemaker, III

[11] Patent Number: 4,479,406

[45] Date of Patent: Oct. 30, 1984

[54] CORK PULLER

[76] Inventor: John V. Shoemaker, III, 1 Shoemaker Dr., Mechanicsburg, Pa. 17055

[21] Appl. No.: 583,614

[22] Filed: Feb. 27, 1984

[51] Int. Cl.[3] ..... B67B 7/06

[52] U.S. Cl. ..... 81/3.46 A

[58] Field of Search ..... 81/3.46 R, 3.46 A, 3.34

[56] References Cited

U.S. PATENT DOCUMENTS

| | | | |
|---|---|---|---|
| 434,192 | 8/1890 | Mills . | |
| 1,707,398 | 4/1929 | Hyland . | |
| 2,516,439 | 7/1950 | Whiteley | 81/3.46 A |
| 2,759,383 | 8/1956 | Mrazik | 81/3.46 A |
| 3,143,904 | 8/1964 | Yerkes | 81/3.4 |
| 3,722,327 | 3/1973 | Strassel | 81/3.1 R |
| 3,842,790 | 10/1974 | Clark | 215/288 |
| 4,018,110 | 4/1977 | Spriggs | 81/3.46 R |
| 4,387,609 | 6/1983 | Polsfuss | 81/3.46 A |

*Primary Examiner*—Roscoe V. Parker
*Attorney, Agent, or Firm*—Thomas Hooker

[57] ABSTRACT

A cork puller includes a handle and a pair of spaced pry arms extending from the handle. Teeth are provided on the top of one arm so that when the arms are inserted between the head of a cork and the lip of a bottle the cork is lifted and rotated.

6 Claims, 4 Drawing Figures

CORK PULLER

The invention relates to an improved cork puller for opening champagne and other bottles closed by corks with expanded heads. The puller is inserted between the cork and the bottle and opens the bottle by simultaneously rotating and extracting the cork. The compound movement facilitates withdraw of tightly seated corks, particularly of the type used to close bottles filled with carbonated or pressurized liquids.

Single movement cork pullers are well known in the art. U.S. Pat. No. 3,842,790 discloses a two armed pry puller for extracting flexible rubber plugs. U.S. Pat No. 3,722,327 discloses a champagne cork puller including a clamp which engages the cork head to aid in pulling. U.S. Pat. No. 1,707,398 discloses a two armed cork puller where the arms are inserted into the neck of the bottle to engage opposite sides of a cylindrical cork for pulling. Finally, U.S. Pat. No. 3,143,904 discloses a cap opener where the sides of the cap are jammed between a smooth surface and a toothed surface to facilitate rotation of the cap.

Champagne and other headed corks are frequently difficult to pull. The corks are hard to hold and are often seated too tightly within the neck of the bottle to permit easy manual extraction, either by direct pulling, rotation or a combination of the two. Even when successfully pulled the corks may be removed too rapidly with an unexpected and rapid release of pressure. The contents may bubble out of the bottle, spill and be wasted.

The puller includes two spaced arms which are forced between the cork and bottle lip, thereby moving the cork axially outwardly of the bottle. Teeth on the upper surface of one arm form a stepped ramp. The other arm is smooth. The ramp teeth engage the extended head of the cork so that the cork rotates as it is withdrawn axially. After the cork is started in this manner, pulling may be completed by additional insertion of the puller and rotating the puller between the cork and the lip to pry the cork out of the bottle.

Other objects and features of the invention will become apparent as the description proceeds, especially when taken in conjunction with the accompanying drawings illustrating the invention, of which there is one sheet and one embodiment.

Figure 3:
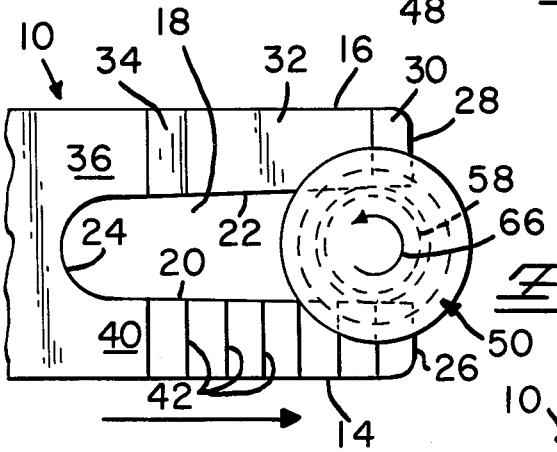
FIGS. 3 and 4 are top views illustrating use of the puller.
Figure 4:
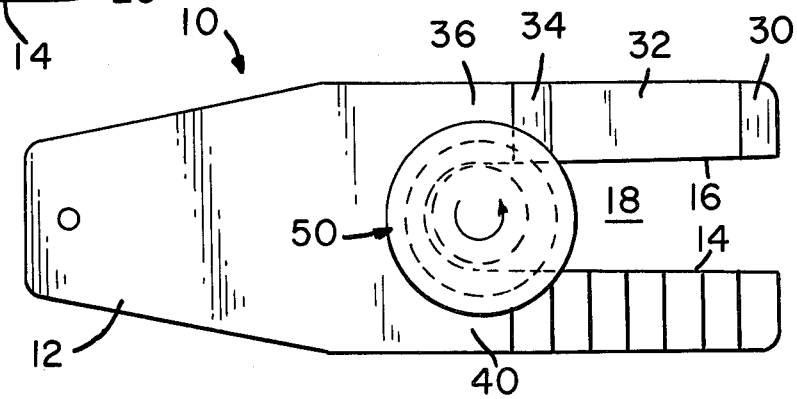

Cork puller 10 includes a flat handle 12 with a pair of pry arms 14 and 16 extending from one end of the handle. As shown in FIG. 3, the arms 14 and 16 are spaced apart by a cork slot 18 defined by the inner edges 20 and 22 of the arms and a rounded bottom 24 at handle 12. The arms 14 and 16 extend outwardly of the handle parallel to each other and are spaced apart a distance somewhat greater than the diameter of the cork plug. The edges 20 and 22 diverge outwardly from bottom 24 to facilitate movement of the puller around a cork plug.

The thickness of the pry arms 14 and 16 increases from thin insertion arm tips 26 and 28 to the maximum thickness of the handle 12. The upper surface of arm 16 includes a lead-in ramp 30 adjacent end 28, a flat surface 32 extending from the lead-in ramp toward handle 12, and a steep ramp surface 34 extending from the end of the flat surface to a raised flat surface 36 which is an extension of the upper surface of handle 12.

Figure 1:
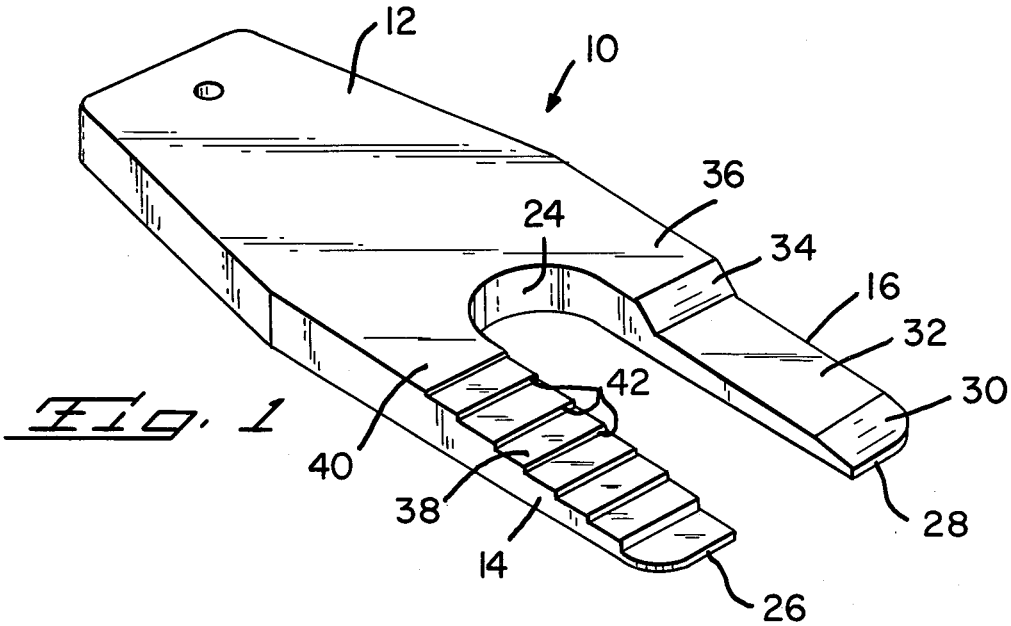
FIG. 1 is a perspective view of a cork puller according to the invention.
Figure 2:
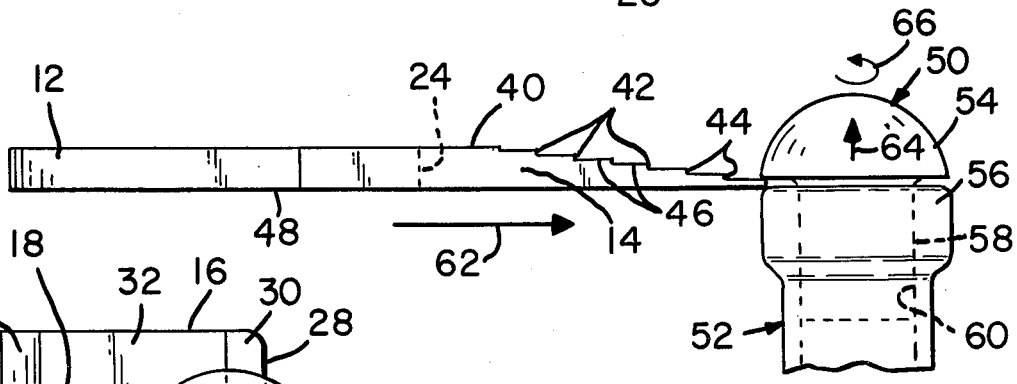
FIG. 2 is a side view illustrating insertion of the puller between a cork and the lip of the bottle.

The upper ramp surface 38 of arm 14 slopes upwardly from narrow insertion tip 26 to a raised flat surface 40 which is an extension of the top surface of handle 12. Surface 38 includes a plurality of transverse step teeth 42 each defined by the intersection of a short rise surface 44 and a horizontal step surface 46. As shown in FIG. 3, the top tooth 42 of arm 14 is located opposite the top of the steep ramp 34 of arm 16 and surfaces 36 and 40 extend outwardly an appreciable distance beyond the bottom of slot 18. As shown in FIG. 2, the flat bottom surface 48 of puller 12 extends from the handle and along the bottoms of the arms 14 and 16.

Cork puller 10 is used to remove or pull champagne-like corks from bottles. FIG. 2 illustrates such a cork 50 fitted within the top of bottle 52. The cork includes an expanded head 54 which extends over the bottle lip 56 and a stem or plug 58 which is tightly fitted within the mouth 60 of the bottle. When the cork is fully seated the head rests flush on the lip.

Drawing of the cork is achieved by first piloting the arm tips 26 and 28 between the bottle lip and the head of the cork and then pushing the puller 10 further toward the bottle as indicated by arrow 62 in FIG. 3. As the puller is forced toward the bottle, the arms bottom on the bottle lip 56 and teeth 42 on arm 14 engage the head of the cork and draw the cork directly outwardly of the bottle as indicated by arrow 64. At the same time, the teeth 42 bite into the bottom of one side of the cork head thereby exerting a torque on the cork so that the cork is rotated in the direction of arrow 66 shown in FIGS. 2 and 3.

The cork is lifted and rotated simultaneously in the direction of arrows 64 and 66 as the puller is inserted. In this way the cork is effectively started and partially withdrawn from its initial seated position. Manipulation of the puller gradually withdraws cork 50 outwardly of the bottle 52 thereby increasing spacing between the cork head 54 and lip 56. During initial pulling the head is moved free of surface 32, thereby avoiding frictional contact engagement with surface 32 of puller arm 16 which would tend to counteract the torque exerted on the cork by teeth 42.

Further drawing of the cork may be achieved by reinserting, prying and rotating the puller so that the cork is fully drawn or drawn sufficiently to enable the pulling to be completed manually. During final pulling head of the cork is withdrawn sufficiently to permit bottoming of the stem in the slot 18 so that the cork head engages surfaces 36 and 40 and the full thickness of the puller may be used to pry the remainder of the cork from the bottle.

While I have illustrated and described a preferred embodiment of my invention, it is understood that this is capable of modification, and I therefore do not wish to be limited to the precise details set forth, but desire to avail myself to such changes and alterations as fall within the purview of the following claims.

What I claim my invention is:

1. A cork puller including a handle, a pair of pry arms extending from one end of the handle, the pry arms having top and bottom surfaces with the bottom arm surfaces lying in a common plane, narrow tips on the free ends of the arms, a cork slot separating the arms, the top to bottom thickness of the arms increasing in a direction from the tips toward the handle, and a plurality of cork engaging teeth on the top surface of one arm only whereby insertion of the cork puller between the lip of the bottle and a headed cork seated in the bottle simultaneously extracts and rotates the cork.

2. A cork puller as in claim 1 wherein said teeth extend transversely across the top surface of said one arm.

3. A cork puller as in claim 2 wherein such top surface includes a plurality of short rise surfaces and a plurality of flat step surface, such rise and step surfaces intersecting at said teeth.

4. A cork puller as in claim 3 wherein the top surface of the other arm includes a flat surface and a steep surface between the flat surface and the top of the puller.

5. A cork puller as in claim 4 wherein each arm includes a flat top surface extending a distance outwardly from the bottom of the cork slot parallel to the bottom surfaces.

6. A cork puller as in claim 5 wherein the width of the cork slot increases outwardly of the handle.

* * * * *